United States Patent [19]

Fedder et al.

[11] Patent Number: 5,028,098

[45] Date of Patent: Jul. 2, 1991

[54] MODULAR COUNTER WORK STATION FOR TELLERS

[75] Inventors: Judith A. Fedder, Aurora; John L. Bartolomeo, Chicago; Delveeta E. Baranski, LaGrange, all of Ill.

[73] Assignee: Standard Federal Bank for Savings, Chicago, Ill.

[21] Appl. No.: 477,676

[22] Filed: Feb. 9, 1990

[51] Int. Cl.[5] ..... A47B 96/18

[52] U.S. Cl. ..... 312/140.3; 312/196

[58] Field of Search ..... 312/140.1, 194, 196, 312/208, 223

[56] References Cited

U.S. PATENT DOCUMENTS

| | | | |
|---|---|---|---|
| 1,420,942 | 6/1922 | Peyton | 312/140.1 |
| 4,323,291 | 4/1982 | Ball | 312/194 |
| 4,515,086 | 5/1985 | Kwiecinski et al. | 312/196 X |
| 4,637,666 | 1/1987 | Worrell et al. | 312/196 |

*Primary Examiner*—Joseph Falk

*Attorney, Agent, or Firm*—Mason, Kolehmainen, Rathburn & Wyss

[57] ABSTRACT

A modular counter-type work station for use by tellers in dealing with customers in a public area includes a counter top at a convenient working level above the floor having a generally U-shaped configuration with a front bight portion publicly accessible on the outside for direct customer access and a rearwardly extending teller section comprising a pair of parallel, opposite side leg portions joined at the forward end to the bight portion. A first cabinet is provided at a central location below the bight portion to support the counter top and a pair of second cabinets are provided for supporting the rearwardly extending leg portions. The cabinets define open corner leg spaces for the tellers while seated on opposite sides of the first cabinet. A counter top cabinet is provided above the level of the counter top to divide the bight portion between a public access or forward section and a rearward teller access section. A pair of teller windows are formed by the counter top cabinet for providing access between customers and tellers. A plurality of the modular work stations may be aligned and connected side by side to provide an elongated row of teller stations and a common panel structure and forward counter top may be provided to match the architectural dress of the facility in which the work stations are used.

12 Claims, 3 Drawing Sheets

MODULAR COUNTER WORK STATION FOR TELLERS

BACKGROUND OF THE INVENTION

1. Field of the Invention

The present invention relates to modular, counter-type work stations for use by tellers in dealing with customers in a public area. More particularly, the modular work stations are especially well adapted for use in banks, savings and loans, and other financial institutions, as well as in postal stations, ticket sale facilities and other types of financial institutions where separation between public customers and tellers is desired.

2. Background of the Prior Art

In the past, teller stations in banks, savings and loans, insurance companies and other financial institutions were generally designed on an ad hoc basis with little thought to providing an efficient work space which is user friendly to tellers and other employees in dealing with the public. With the advent of new and improved teller equipment including computers, terminals, printers and other modular types of calculators, signature verifying equipment, etc., it is desirable and an object of the present invention to provide a new and improved modular, counter-type work station for tellers which improves and enhances the efficiency of operations in utilizing new state of the art, modern equipment now becoming available.

It is another object of the present invention to provide a new and improved modular work station which saves space and reduces space planning requirements for architects and designers.

Another object of the present invention is to provide a new and improved modular, counter-type work station of the character described which is easily installable and yet can be taken down after installation for removal and relocation to other facilities.

Still another object of the present invention is to provide a new and improved modular teller station of the character described which can be assembled together with similar stations in an elongated row or line and utilizing a common counter front adapted to meet the particular decor of the building environment.

Still another object of the present invention is to provide a new and improved, highly efficient, modular, dual-teller, counter-type work station which is relatively low in cost, extremely efficient in operation and which provides a labor saving advantage for tellers working at the station.

BRIEF SUMMARY OF THE INVENTION

The foregoing and other objects and advantages of the present invention are accomplished in an illustrated embodiment comprising a new and improved modular, counter-type, work station for use by one or more tellers in dealing with customers in a public area on a forward side of the work station. The work station includes a counter top of generally U-shaped configuration supported above the floor at a convenient working level and having a front or bight portion facing a public area and a pair of rearwardly extending leg portions defining a teller work area therebetween. A centrally located first cabinet is provided for supporting the frontal bight portion of the counter top and defines a pair of open leg spaces on opposite sides for accommodating the tellers who are seated on movable stools between the rearwardly extending leg portions of the U-shaped counter top Second cabinets are provided for supporting the leg portions of the counter top adjacent and rearwardly of the leg spaces. A counter top cabinet is mounted above the frontal portion of the counter top for dividing the same into a public accessible, forward section and a rearward teller section. The top cabinet defines a pair of teller windows for direct customer access to the tellers seated behind the forward portion of the counter. The counter top cabinet means includes a central cabinet section between the teller windows and side cabinets on either side thereof for holding transaction forms and the like. Rearwardly extending cabinet segments are provided on the leg portions of the counter top for holding completed transaction forms. The first cabinet is suitable for supporting a printer accessible to both tellers and movably mounted on a slide support between a retracted position beneath the counter top and an outwardly extended position ready for use. The second cabinets have drawers for currency storage and provide additional storage for forms and the like. Video display terminals and calculators are positioned on the counter top above the leg spaces for convenient access to the tellers when making transactions with customers facing the teller windows. Teller accessible counter top working space is readily available on the teller section of the frontal bight portion of the counter top as well as work space of the leg portions of the counter top.

BRIEF DESCRIPTION OF THE DRAWINGS

For a better understanding of the present invention, reference should be had to the following detailed description taken in conjunction with the drawings, in which.

DETAILED DESCRIPTION OF A PREFERRED EMBODIMENT OF THE PRESENT INVENTION

Figure 1:
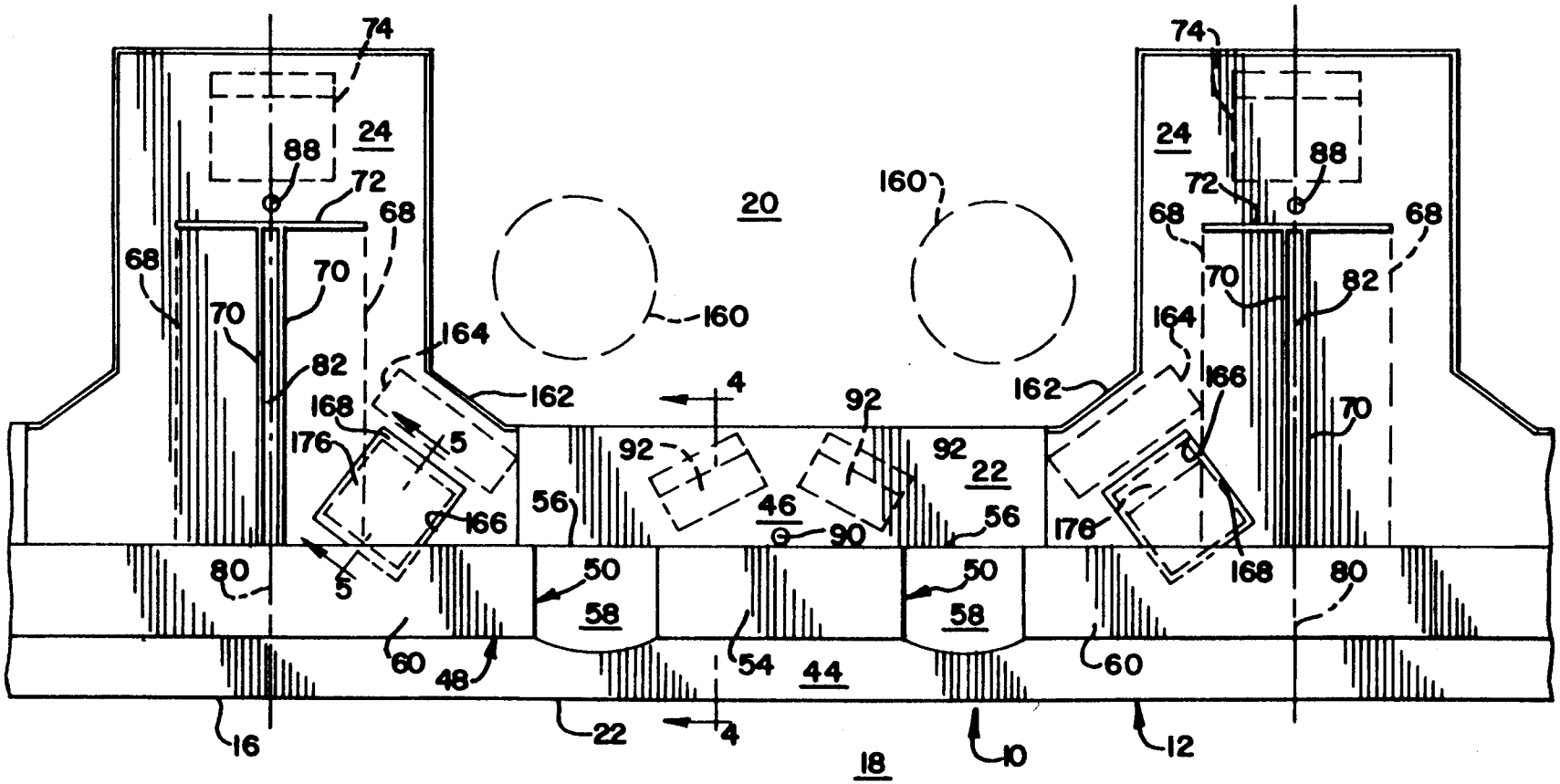
FIG. 1 is a top plan view of a work station constructed in accordance with the features of the present invention.

Referring now more particularly to the drawing, therein is illustrated a new and improved modular, counter-type work station especially designed and adapted for use by one or more tellers, cashiers, ticket sellers, etc. for use while dealing with customers in a public area on a forward side of the work station. The work station is generally referred to by the numeral 10 and includes a generally U-shaped counter top 12 supported above a floor 14 at a convenient working level. A plurality of modular work stations 10 may be aligned in side by side relationship forming an elongated row 16 of stations dividing the floor area 14 into a public access or customer service area 18 in front of the row and a teller work area or work station area 20 rearwardly of the row as best shown in FIG. 1.

Figure 2:
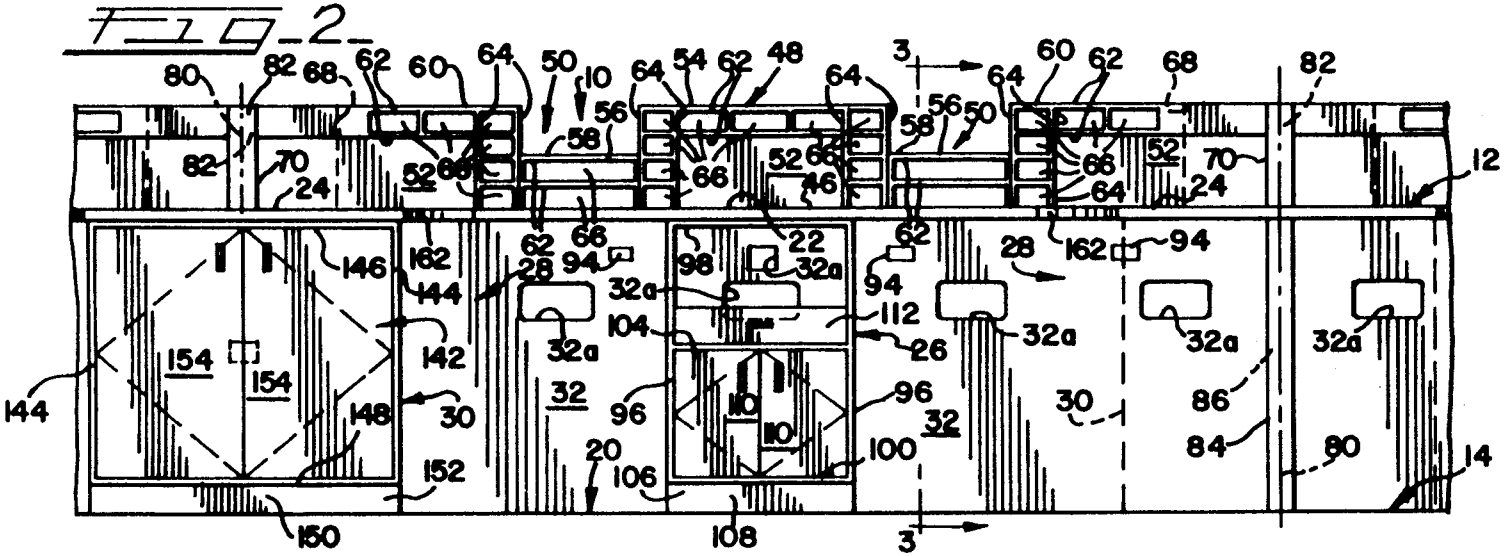
FIG. 2 is an elevational view of the work station taken from a rearward or teller's side.
Figure 3:
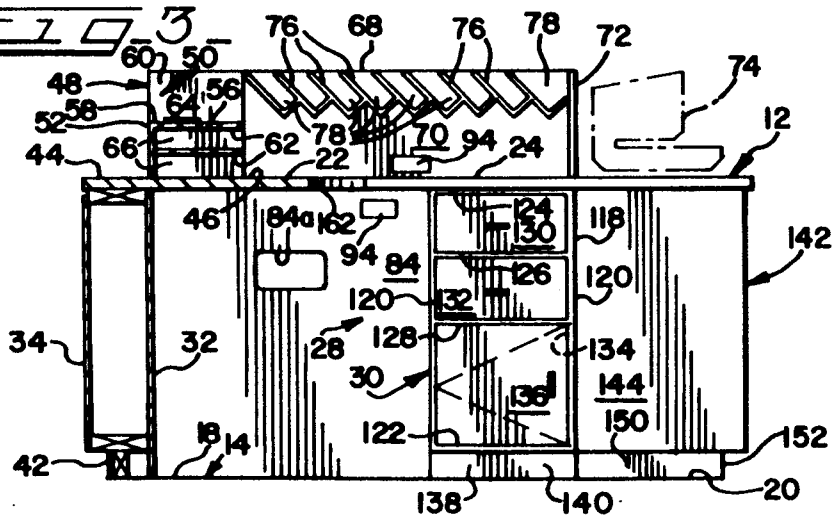
FIG. 3 is a transverse cross-sectional view taken substantially along lines 3—3 of FIG. 2.
Figure 4:
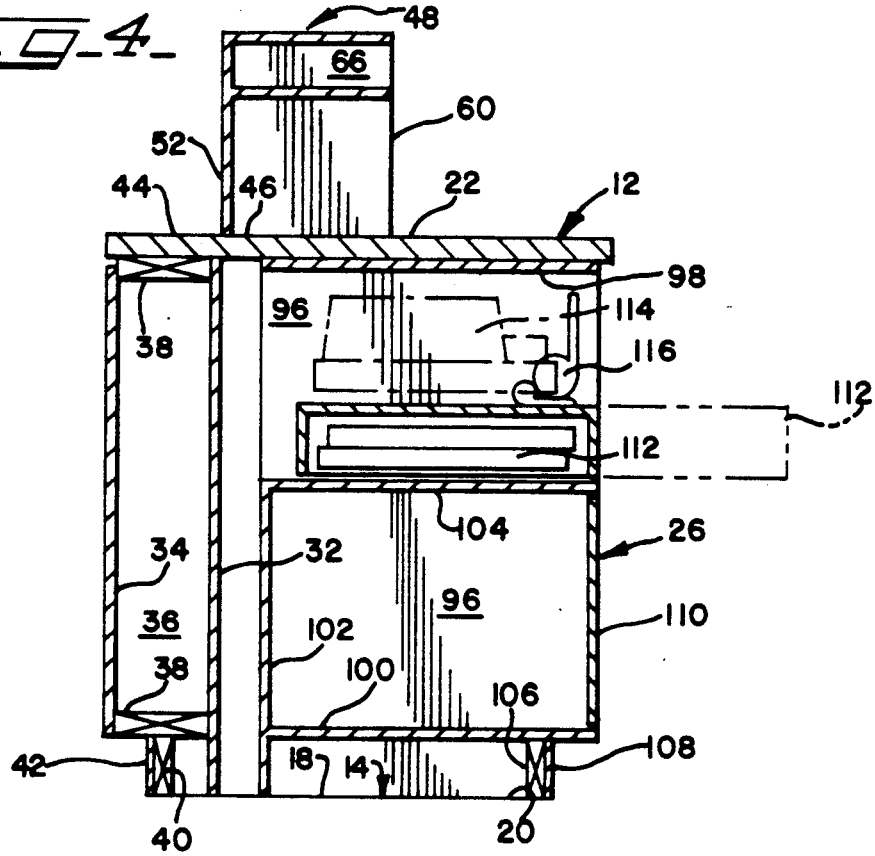
FIG. 4 is a transverse cross-sectional view taken substantially along lines 4—4 of FIG. 1.

Each U-shaped counter top includes a front or bight portion 22 and a pair of side leg portions 24 extending rearwardly from opposite end portions thereof. The central bight portion 22 of the counter top is supported in part by a central under counter cabinet 26 (FIG. 2) which divides the space beneath the counter top into a pair of open leg spaces 28 for the tellers. Each leg portion of the U-shaped counter top is supported in part by an under counter side cabinet 30 spaced rearwardly of a leg space 28. As best shown in FIGS. 2, 3 and 4, the open space beneath the front or bight portion 22 of the U-shaped counter top 12 and above the floor 14 is closed off by means of a front wall or panel 32 forming an inner front wall of the leg spaces 28 on opposite sides of the central cabinet 26. An outer panel 34, facing the public area 18 is spaced outwardly of the inner front panel 32 defining a plenum chamber 36 between the panels for use in holding cables, wires and other electrical lines used in the teller work station 10.

As illustrated in FIG. 2, a plurality of access openings **32*a* are provided in the panel 32 at suitable intervals beneath the counter top to afford access to the plenum chamber 36 which preferably runs along the entire row 16 of modular work stations 10 assembled together. The outer frontal panel 34 is supported in spaced apart relation to the inner panels 32 by a plurality of elongated structural spacers 38 and the outer face of the outer panel may extend across several modules 10 to afford a desired decorative effect for a row 16 of work stations in a bank, savings and loan or other financial institution, to match the decor. The lower spacer 38 is supported on an elongated structural member 40 to provide a kick or toe space 42 extending along the length of the row 16**.

The bight portion 22 of each U-shaped counter top 12 of a work station 10 is divided between a frontal or forward section 44 of relatively narrow width for use by customers in the public area 18 and rearwardly of the frontal section, the tellers are provided with a much larger, rearwardly extending teller section 46 for use in supporting machines and providing a convenient work space.

In accordance with the present invention, the frontal section and teller section of the counter top portion 22 are separated by an upstanding, front counter top cabinet 48 defining a pair of spaced apart teller access windows 50 on opposite sides of the central cabinet 26 above the open leg spaces 28 immediately therebelow. The front counter top cabinet 48 includes a front wall 52 facing outwardly towards the public area 18 and includes a central cabinet segment 54 directly between the spaced apart teller windows 50. A pair of small, under window, cabinet segments 56 are provided directly beneath elevated window counter tops 58, spaced above the level of the public access front counter top section 44. The front counter top cabinet 48 also includes a pair of outer side cabinet segments 60 extending from opposite outer sides of the respective teller access windows 50. In addition to the front wall 52, each of the counter top cabinet segments 54, 56 and 60, respectively, of the counter top front cabinet 48 includes a plurality of horizontal walls or shelves 62 and a plurality of vertical side walls and divider walls 64 which form a plurality of individual storage spaces 66 for accommodating a supply of numerous transaction forms, tickets, etc., commonly used by a teller in transacting business at the work station 10.

Each teller work station 10 also includes a pair of counter top side cabinets 68 extending rearwardly from a frontal side cabinet segment 60 and supported above a leg portion 24 of the U-shaped counter top 12. Each side cabinet segment 68 includes a vertical back wall 70 and a rear end wall 72, terminating short of a rearward end of a supporting counter top leg portion 24 to provide a convenient working space for supporting a machine 74 of a type used for checking signatures.

Along an upper portion, each counter top side cabinet 68 is provided with a row of angled, L-shaped dividers 76 arranged to provide a plurality of open, storage spaces 78 used for holding and collecting completed transaction forms, etc. As best shown in FIG. 1, the back walls 70 of the respective counter top side cabinets 68 are spaced inwardly from an outer edge of the counter top work station module 10 as represented by module dividing lines 80. This inward spacing between adjacent back panels 70 provides a plenum chamber 82 between each pair of adjacent work station modules 10 placed along the row 16.

Below each counter top leg portion 24 of the U-shaped counter top 12, there is provided a supporting side leg back wall 84 spaced directly below the cabinet wall 70 and forming a lower side plenum chamber 86 for accommodating cables and electrical supply wires, harnesses and the like. As shown in FIG. 3, each lower side panel back wall 84 is provided with one or more access openings **84*a* similar to the openings 32*a* in the front panels 32. As shown in FIG. 1, the side leg portions 24 of each U-shaped counter top 12 are provided with cable openings 88 adjacent the end wall 72 of the side leg counter top cabinets 68. Cables from the plenums 82 may pass through the openings 88 to supply the necessary electronics and power to the signature checking machine 74 and/or other machines on the rearward portion of the counter top. Similarly, a frontal cable opening 90 is provided on the teller section 46 of the bight portion 22 of the U-shaped counter top 12 in order to supply access for cables running to and from the front plenum chamber 36 to power calculators 92 or other electronic machines as may be required by the tellers operating in the work stations 10. A number of convenience outlets 94 may also be provided under the U-shaped counter top 12 on the panels 32 and 84 as shown in FIGS. 2 and 3**.

In accordance with the invention, the U-shaped counter top 12 is supported from the floor 14 by the front panels 32 and the central cabinet 26 along the front portion 22 and along each side leg portion 24 by the side panels 84 and side cabinets 30. The central, under counter cabinet 26 includes a rectangular frame comprising vertical side walls 96, a top and bottom wall 98 and 100, a lower back wall 102 and an intermediate shelf 104. The rearward portion of the bottom wall 100 is supported by a structural element 106 to define a toe or kick space 108 as shown in FIG. 4. Cabinet space bounded by the shelf 104, bottom wall 100, side walls 96 and back wall 102 is provided for storage and a pair of hinged doors 110 complete the enclosure to provide a neat appearance for the cabinet structure. The shelf 104 provides support along with the side walls 96 for a sliding drawer base 112 movable between a retracted position beneath the top wall 98 and an outwardly extended position shown in dotted lines in FIG. 4. The drawer slide is used to support a common printer 114 or other machines as may be required for use by the tellers at the work station 10. An eccentric last handle mechanism 116 is provided for locking the position of the drawer slide 112 once selected.

Each of the under counter side cabinets 30 includes a side section 118 having a pair of vertical side walls 120, a bottom wall 122, a top wall 124 and a pair of intermediate drawer supporting shelves 126 and 128. An upper cash drawer 130 is supported on the shelf 126 and if needed, a second lower cash drawer 132 is supported on the lower shelf 128. Below the lower cash drawer 132, the lower side section cabinet 118 is provided with a storage compartment 134 and a hinged door 136 is provided for closing the compartment as desired. The bottom wall 122 of the side cabinets 118 is supported above the level of the floor section 20 by a support member 138 forming a kick space 140 similar to the toe space 108 of the counter and other cabinets.

Each side leg under counter cabinet 30 also includes a rearwardly facing, rear cabinet section 142 having a pair of side walls 144, a top wall 146, a bottom wall 148 and a structural member 150 for supporting the bottom wall above the level of the adjacent floor 20 to provide a rearwardly facing kick space 152 similar to the other toe or kick spaces as described. Preferably, each rear cabinet sections 142 is constructed to be separate from the side cabinet sections 118 and one rear cabinet section 142 is utilized at the end of a pair of adjacent side leg portions 24 of a pair of adjacent work stations 10 aligned in a row 16 as described. Each of the rear cabinet sections 142 is provided with a pair of rearwardly opening cabinet doors 154 and the interior space of the cabinets can be provided with shelves, dividers and suitable means for the storage of a wide variety of equipment.

In accordance with the present invention, the modular, counter-type work station 10 is designed to efficiently accommodate a pair of tellers who may be seated on movable teller stools 160 in the teller space 20 between opposite side leg portions 24 of the U-shaped counter top 12. A teller seated on a stool has direct access through a teller window 50 to the general public standing outside the row 16 of work stations 10 in the public area 18. While seated on a teller stool 160, the teller has rapid and easy access to the storage spaces 66 in the front counter top cabinet 48 and the side counter top cabinets 68. In addition, the teller has easy and direct access to machines such as electronic calculators 92, etc., mounted on the rearward segment 46 of the frontal bight section 22 of the U-shaped counter top 12. In addition, both tellers seated on the stools 160 have shared access to a printer 114 which is mounted on the drawer slide 112 of the center below counter cabinet 26.

Figure 5:
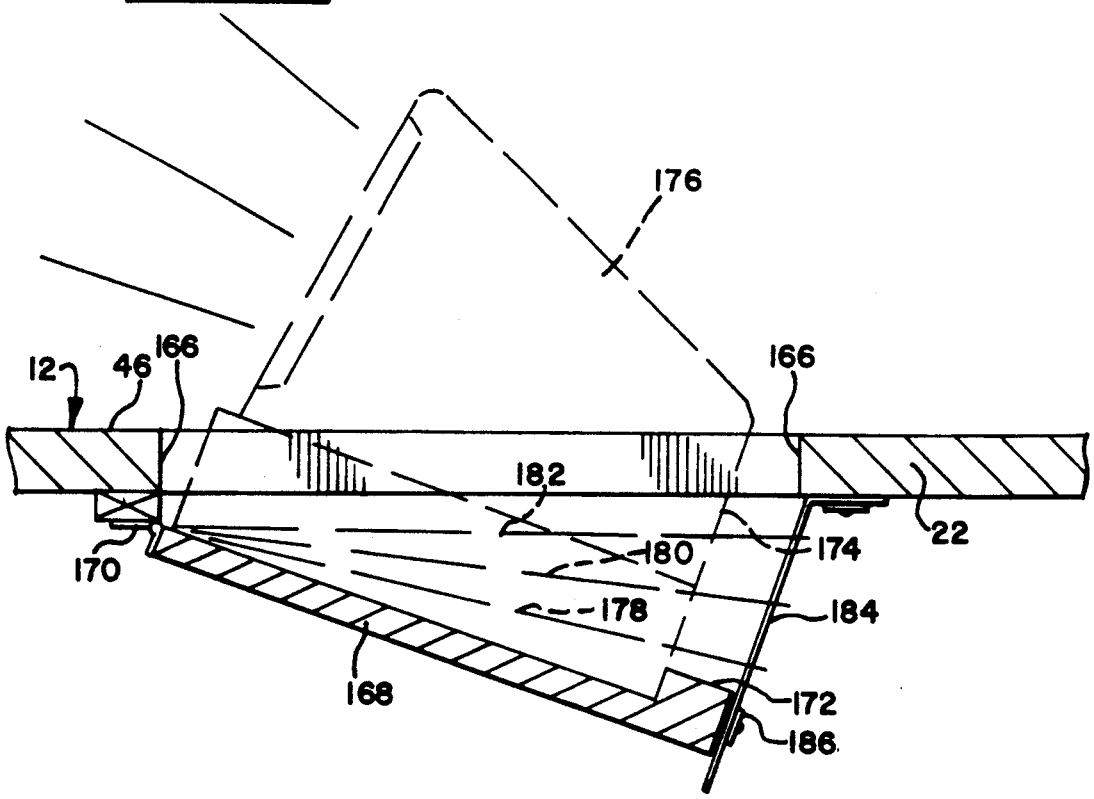
FIG. 5 is a fragmentary cross-sectional view taken substantially along lines 5—5 of FIG. 1.

Referring specifically to FIG. 1, the U-shaped counter top 12 is formed with angled gusset-like segments 162 at the junction between the frontal rear segment 46 of the bight portion 22 and the rearwardly extending side leg portions 24. Counter top space immediately adjacent the gusset segments 162 can readily accommodate a computer keyboard 164 and rearwardly of the keyboard, the bight portion 22 of the counter top is formed with a relatively large rectangular opening 166 having a shelf 168 pivoted to a front side of the opening by hinges 170 (FIG. 5). At a rearward edge, the shelf is provided with an elongated rib 172 used for stopping engagement against the rearward edge of a video display, terminal base 174 that is mounted on the shelf for supporting a video display terminal 176 viewed directly by a teller seated on a teller stool 160. The support shelf 168 is pivotal between a variety of different angular positions represented by the ray lines 178, 180 and 182 so that the angle of the video terminal display facing the teller may be changed as desired to suit the teller's personal needs. Moreover, the height of the video display terminal above the level of the counter top section 46 may be adjusted as necessary. In order to secure the angular position of the shelf 168 in a selected position, a downwardly extending metal bracket 184 is secured to the counter top segment 22 immediately adjacent the forward edge of the rectangular opening 166. The bracket 184 is formed with a plurality of spaced apart openings along the depth thereof and removable pins 186 are adapted to seat in the openings at a selected level to extend into the edge of the shelf rib 172 for holding the shelf 168 in the desired angular position.

The U-shaped modular work stations 10 in accordance with the present invention, are easily adapted to be aligned along a common row 16 in a bank, savings and loan office or other financial institution where tellers or cashiers are present and some separation from the public area is a requirement. Each teller has direct access to the customers in the public area through a forward viewing teller window 50 and has direct access to storage spaces 66 and 78 which are within easy reach. In addition, ample counter space is provided for calculators and other machines and a video display terminal 176 having an angularly adjustable screen or face is provided in direct view of the teller as well as direct access to a controlling keyboard 164. Plenum chambers along the front end and opposite sides of the work station 10 provide for easy wiring and electrical connections to the teller work station 10 and the various electronic and machine components carried therein. The work station 10 may be readily knocked down or disassembled and moved to different locations and the stations do provide a neat and architecturally desirable appearance for financial institutions, insurance companies, etc., wherein the public is contacted.

Many modifications and variations of the present invention are possible in light of the foregoing specification and thus, it is to be understood that within the scope of the appended claims, the invention may be practiced otherwise than as specifically described.

What is claimed and desired to be secured by Letters Patent of the United States is:

1. A modular, counter-type work station for use by one or more tellers while dealing with customers in a public area on a forward side thereof, comprising:

counter top means supported at a convenient working level above a floor of generally U-shaped configuration having a bight portion with a publicly accessible forward section for direct customer access available from said public area and a rearwardly extending, teller section for working access by said tellers, said counter top means including a pair of generally parallel, side leg portions joined with opposite end portions of said bight portion and extending rearwardlyaway from said public area, said bight portion and said leg portion defining a work area for said tellers generally open on a back side facing away from said public area;

first cabinet means supporting said bight portion above said floor intermediate said end portions and defining leg spaces for said tellers on opposite sides beneath said end portions of said bight portion;

second cabinet means for supporting said leg portions adjacent and rearwardly of said leg spaces;

counter top cabinet means above said bight portion of said counter top dividing the same between said public access forward section and said teller section and defining a pair of teller windows for customer access to said tellers on opposite sides of said cabinet means;

and panel means below said counter top means extending along said bight portion for closing off said leg spaces between said counter top means and said floor on opposite sides of said first cabinet means;

said panel means including an outside front panel facing said public area and an inside front panel spaced apart rearwardly thereof defining a front plenum chamber therebetween for cables and the like for connection to electrical components in said work station;

said panel means including at least one side panel means extending rearwardly of said bight portion below said counter top means for closing off a leg space from a laterally adjacent area outside of said work station out of said public area;

said side panel means including a pair of spaced apart inner and outer side panels defining a side plenum chamber therebetween for cables and the like for connection to electrically powered components in said work station, said front plenum chamber in communication with a forward end of said side plenum chamber.

2. The modular, teller work station of claim 1, wherein:

said first cabinet means is in communication with said front plenum chamber.

3. The modular, teller work station of claim 1, wherein:

said second cabinet means is in communication with said side plenum chamber.

4. The modular, teller work station of claim 1, wherein:

said counter top cabinet means includes a front wall extending upwardly of said bight portion between said public area and said work station; and said front wall having a pair of spaced apart openings therein defining said teller windows.

5. The modular, teller work station of claim 4, including:

a plurality of counter tops in said teller windows spaced above said counter top means and defining a rearwardly opening storage space therebetween behind said front panel accessible to said tellers.

6. A modular, work station for tellers dealing with customers in a public area, comprising:

counter top means supported at a convenient working level above a floor of generally U-shaped configuration having a front portion with a publicly accessible forward section for direct customer access available from said public area and a rearwardly extending, teller section for working access by said tellers, said counter top means including a pair of generally parallel, side leg portions joined with opposite end portions of said front portion and extending rearwardly away from said public area, said front portion and said leg portion defining a work area for said tellers generally open on a back side facing away from said public area;

first cabinet means for supporting said front portion above said floor intermediate said end portions and defining leg spaces for said tellers on opposite sides beneath said end portions of said front portion;

second cabinet means including a pair of spaced apart second cabinets for supporting each of said leg portions at a rearward end adjacent and rearwardly of said leg spaces;

counter top cabinet means projecting above said front portion of said counter top means dividing the same between said public access forward section and said teller section and defining a pair of spaced apart teller windows for direct customer access to said tellers on opposite sides of said counter top means;

an elevated counter top section forming a bottom of each of said teller windows spaced above said front portion of said counter top means and defining a top of a cabinet space closed to the public and accessible to said tellers;

said counter top cabinet means including a front wall projecting upwardly of said front portion of said counter top means dividing the same between said public front section and said teller section and closing off public access to said cabinet spaces below said teller windows;

said counter top cabinet means including a central section between said teller windows and a pair of outer sections on opposite sides of said windows, said central and outer section closed off to public access by said front wall and open rearwardly for access by said tellers; and at least one of said central and outer sections of said counter top cabinet means includes space divider means for dividing the sections into a plurality of smaller segments for the storage of forms used at said work station.

7. The modular work station of claim 6, wherein:

said counter top cabinet means includes at least one side cabinet means above a side leg portion of said counter top means extending rearwardly of said front wall, said side cabinet means including an outside wall extending upwardly of said counter top means for closing off access from outside said work station out of said public area.

8. The modular work station of claim 7 wherein:

said side cabinet means includes a space dividing bottom wall structure extending inwardly toward said work area at a level above said counter top means defining a plurality of smaller spaces for transaction forms used at said work station.

9. The modular work station of claim 6, including:

printer means supported by said first cabinet means for access by tellers adjacent said teller windows; and wherein said first cabinet means includes slide means for supporting said printer means for movement between a first position under said bight portion of said counter top means and a second position outwardly thereof away from said public area between said tellers.

10. The modular work station of claim 6, including:

currency storage means carried in said second cabinet means; and said second cabinet means includes a plurality of side cabinets below said leg portions of said top counter means.

11. The modular work station of claim 6, including:

at least one video display means supported on said bight portion of said counter top means and facing away from said public area toward a teller behind said bight portion of said counter top means; and teller adjustable support means for said video display means for raising and lowering the same relative to the level of said counter top means.

12. The modular work station of claim 6, including:

at least an additional one of said modular work stations positioned with a leg portion of said counter top means thereof adjacent a leg portion of said counter top means of said first mentioned work station, said bight portions of said counter top means of said work stations extending in alignment along a row; and common panel means extending along said row facing said public area and extending below said aligned counter top means of said work stations.

* * * * *